US008533911B2

(12) United States Patent
Lehrkamp

(10) Patent No.: US 8,533,911 B2
(45) Date of Patent: Sep. 17, 2013

(54) SAFETY LOADING UNIT FOR CEILING TRACK WITH EASY TO USE LATCHING

(75) Inventor: Roger W. Lehrkamp, Milwaukee, WI (US)

(73) Assignee: InPro Corporation, Muskego, WI (US)

( * ) Notice: Subject to any disclaimer, the term of this patent is extended or adjusted under 35 U.S.C. 154(b) by 129 days.

(21) Appl. No.: 13/330,578

(22) Filed: Dec. 19, 2011

(65) Prior Publication Data

US 2013/0152344 A1 Jun. 20, 2013

(51) Int. Cl.
*A47H 15/00* (2006.01)

(52) U.S. Cl.
USPC ..... 16/94 R; 16/96 D; 16/94 D; 16/96 R

(58) Field of Classification Search
USPC ..... 16/94 R, 94 D, 95 R, 95 D, 95 W, 16/95 DW, 96 R, 96 D, 96 L, 231, 232; 238/165, 166; 104/100, 103; 292/83, 306
See application file for complete search history.

(56) References Cited

U.S. PATENT DOCUMENTS

| | | | | |
|---|---|---|---|---|
| 293,339 | A * | 2/1884 | Martin | 16/96 R |
| 1,267,279 | A * | 5/1918 | Scalpelli | 238/166 |
| 3,396,834 | A * | 8/1968 | Luckey et al. | 206/326 |
| 3,913,204 | A * | 10/1975 | Finkbeiner | 29/241 |
| 4,599,763 | A | 7/1986 | Toder | |
| 7,788,769 | B2 * | 9/2010 | Wicker et al. | 16/87 R |
| 7,935,137 | B2 | 5/2011 | Gorhan et al. | |

FOREIGN PATENT DOCUMENTS

DE 3942866 C1 * 8/1990

* cited by examiner

*Primary Examiner* — Jeffrey O Brien
(74) *Attorney, Agent, or Firm* — Lawence S Pope

(57) ABSTRACT

The present disclosure is concerned with an improved latching mechanism for the hinged section of a ceiling track for traveling curtain. The latching mechanism is designed to make a readily audible sound when it is locked. It is based upon a generally oval shaped lock knob which passes through a generally oval shaped aperture in the bottom wall of a receiver for the lock knob. The aperture is designed so that when the lock knob is rotated its long axis no longer aligns with the long axis of the aperture it can no longer pass through the aperture. The bottom wall of the receiver carries two upwardly extending side walls that must be pushed outward to allow the passage of the lock knob as it rotates and that carry gaps that accommodate the tips of the lock knob and allow the side walls to move back toward their undeformed position.

9 Claims, 6 Drawing Sheets

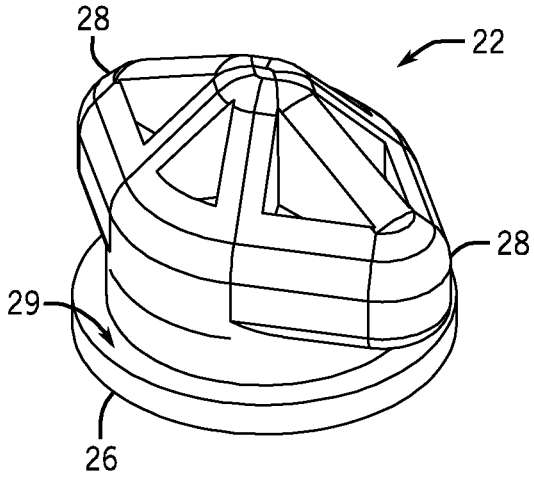
FIG. 2A
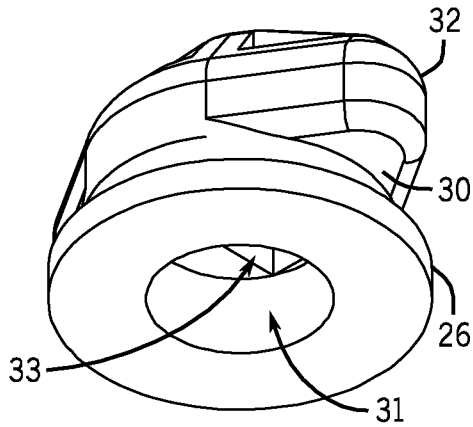
FIG. 2B
FIG. 3
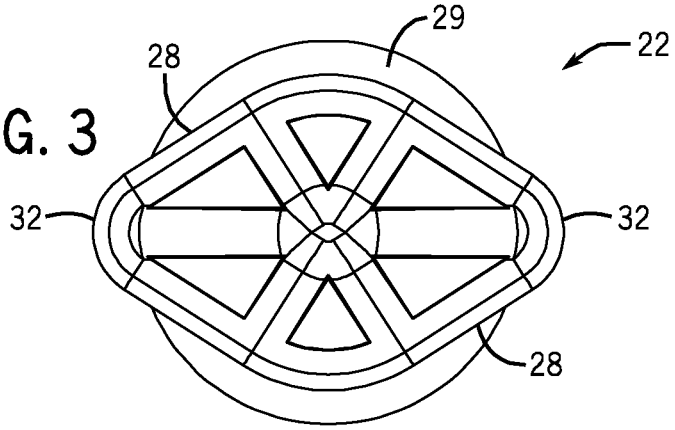
FIG. 4
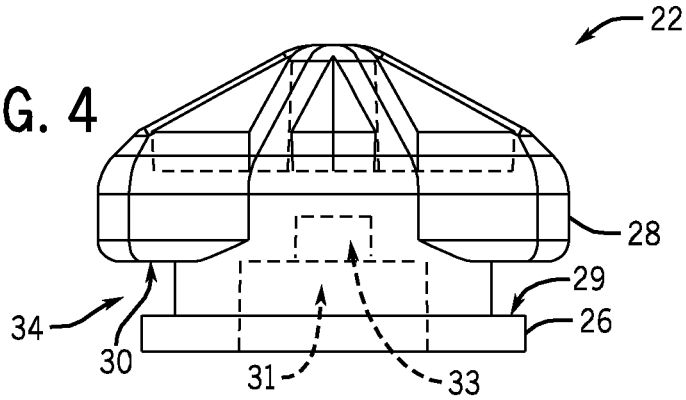

SAFETY LOADING UNIT FOR CEILING TRACK WITH EASY TO USE LATCHING

FIELD OF THE INVENTION

The present invention relates to ceiling mounted curtain tracks which have hinged sections which facilitate the loading and unloading of curtains by allowing easier access to the track and to an improved locking mechanism which releases and secures the hinged section's alignment with the balance of the track to which it is hinged.

BACKGROUND OF THE INVENTION

Ceiling mounted curtain tracks have been adopted for a variety of uses including travelling curtains such as those used in hospitals to establish privacy for certain spaces such as the area around a patient's bed. But the loading and unloading of curtain carriers posed a difficulty because these tracks were adjacent to the ceiling and access to them frequently required a ladder or stepstool which in turn posed a safety risk.

A system was developed in which a portion of the curtain track was hinged so that it could swing down from the ceiling and provide easier access. Curtains attached to carriers adapted to be loaded on the curtain track could be more easily suspended from or removed from such ceiling tracks by sliding these carriers on to the hinged section which had been lowered. Once the curtains were thus loaded onto the lowered hinged section, it could be swung into alignment with the rest of the track and a portion of the carriers from which the curtains were suspended could be slid on to the rest of the track by grasping the suspended curtains without the necessity of being adjacent to the ceiling. Such an approach is described in U.S. Pat. No. 4,599,763.

However, such an approach required a mechanism to secure the hinged section when it was in alignment with the balance of the track and a latching mechanism was developed which interacted with a fixed bracket as described in the above mentioned patent. Persons operating this latching mechanism while standing on the floor faced in accordance with its intended use faced some difficulties. Among others it was not easy to tell if the mechanism had been locked against release of the hinged section and the mechanism did not always readily latch when the hinged section was brought into contact with the fixed bracket.

Therefore there was a need for a locking mechanism which functioned in this environment in a simple and reliable manner to lock and release the hinged section and give a clear and unambiguous indication when the mechanism was locked to the fixed bracket.

SUMMARY OF THE INVENTION

The present invention involves a simple but elegant lock mechanism which functions to secure and release a hinged section of a ceiling track for traveling curtains based on the interaction of a generally oval shaped lock knob with a receiver with a generally oval shaped aperture and elastically deformable side walls, each of which has a gap in which a tip of the lock knob located at the end of its long axis can seat when the lock knob is rotated such that its long axis is generally perpendicular to the long axis of the oval shaped aperture. These side walls are spaced from the axis of rotation of the lock knob such that they are elastically forced outward by the tips of the lock knob as the lock knob rotates from having its long axis parallel to the long axis of the aperture in the bottom wall of the receiver to having its long axis perpendicular to the long axis of this aperture and having these tips seated in the gaps in these walls. The gaps are configured such that when the tips seat in them, these tips project into these gaps allowing at least a partial relaxation of the elastic deformation of the sidewalls. The side walls are constructed such that when the tips seat in the gaps and at least a portion of this elastic deformation is relieved an audible sound is produced. In a preferred embodiment, the lock knob has a ring spaced downwardly from the bottom of its generally oval shaped portion which has a size such that it will not pass through the aperture and has an upper surface which engages the bottom surface of the bottom wall of the receiver. It is spaced from the bottom surface of the generally oval shaped portion of the lock knob to define a gap which accommodates the bottom wall of the receiver when the lock knob is rotated such that its long axis is not aligned with the long axis of said aperture. It is also preferred that the lock knob have a downwardly depending cylindrical shaft about which it rotates. In a particularly preferred construction this shaft connects the oval upper portion of the lock knob to its lower ring and has a diameter which will pass through the aperture.

In a preferred embodiment, the lock knob is rotationally affixed to a flange which is in turn affixed to the hinged section of the ceiling track. In a particularly preferred embodiment, a shaft passes through an aperture in this flange and is secured to the lock knob. It is especially preferred that the lock knob have a recess in its bottom surface into which the top of this shaft is seated.

In a preferred embodiment, the side walls of the receiver are constructed of an injection moldable polymer. In a particularly preferred embodiment, the side walls are so constructed that rotating the lock knob from a locked position with its tips seated in the gaps of the side walls to an open position in which its long axis is aligned with the long axis of the aperture in the bottom wall of the receiver and the lock knob can pass through this aperture is within the manual capacity of an average person. In an especially preferred embodiment, the sidewalls have partial gaps between their lower edges and the bottom wall of said receiver to reduce the amount of force (or torque) necessary to deflect these walls outward to allow full rotation of the lock knob. In a preferred implementation of this approach, these horizontal gaps run from the vertical gaps in which the tips of the lock knob seat part way to where they join the other side walls of the receiver which cross the long axis of the aperture of the bottom wall of the receiver.

In a further preferred embodiment, the gaps in the side wall interact with the tips of the lock knob so that it is readily apparent that these tips have seated in these gaps. This typically involves these tips projecting out of these gaps and being of a distinctive color which contrasts with that of the side walls carrying the gaps. It also involves the placement and orientation such that these gaps and the tips projecting through them are readily visible to a person operating the lock mechanism while standing on the floor.

BRIEF DESCRIPTION OF THE DRAWINGS

FIGS. 2A and 2B are perspective views of the lock knob showing the top and bottom of its bottom ring feature, respectively.

FIG. 3 is a top plan view of the lock knob

FIG. 4 is a side elevation of the lock knob with dashed lines showing internal structure.

DETAILED DESCRIPTION OF THE INVENTION

The present invention is concerned with a latching mechanism for a hinged section of a ceiling track for travelling curtains which can be lowered or raised by a person standing on the floor beneath the ceiling track using a wand which interacts with the latching mechanism. The latching mechanism should function such that there is no ambiguity as to when it is locked and should be easy to operate. It should be capable of being operated numerous times without any noticeable deterioration in its operation. It is preferred that it be constructed of injection moldable parts.

The latching mechanism comprises a generally oval shaped lock knob which is preferably rotatably attached to the hinged section and a receiver which has a generally oval shaped aperture in its bottom wall adapted to receive the lock knob and gapped side walls to restrain the lock knob from rotation when the tips at the ends of the long axis of the lock knob are seated in the gaps of these side walls. The gaps in the side walls are preferably placed such that these tips seat in theses gaps when the lock knob has been rotated so that its long axis is approximately perpendicular to the long axis of the aperture in the bottom wall of the receiver. The side walls themselves are preferably constructed of an elastically deformable material and are spaced such that the tips at the ends of the long axis of the lock knob force them outward when the lock knob is rotated. These tip interact with the side walls such that when these tips seat in the gaps in these sidewalls, the side walls relax inward toward the axis of rotation of the lock knob and in so doing produce a readably audible sound. It is preferred that these tips protrude through these gaps so as to be visible when viewing the outside of these side walls. This visibility may preferably be enhanced by giving these tips a distinctive color which contrasts with the exterior surfaces of these side walls.

Figure 1:
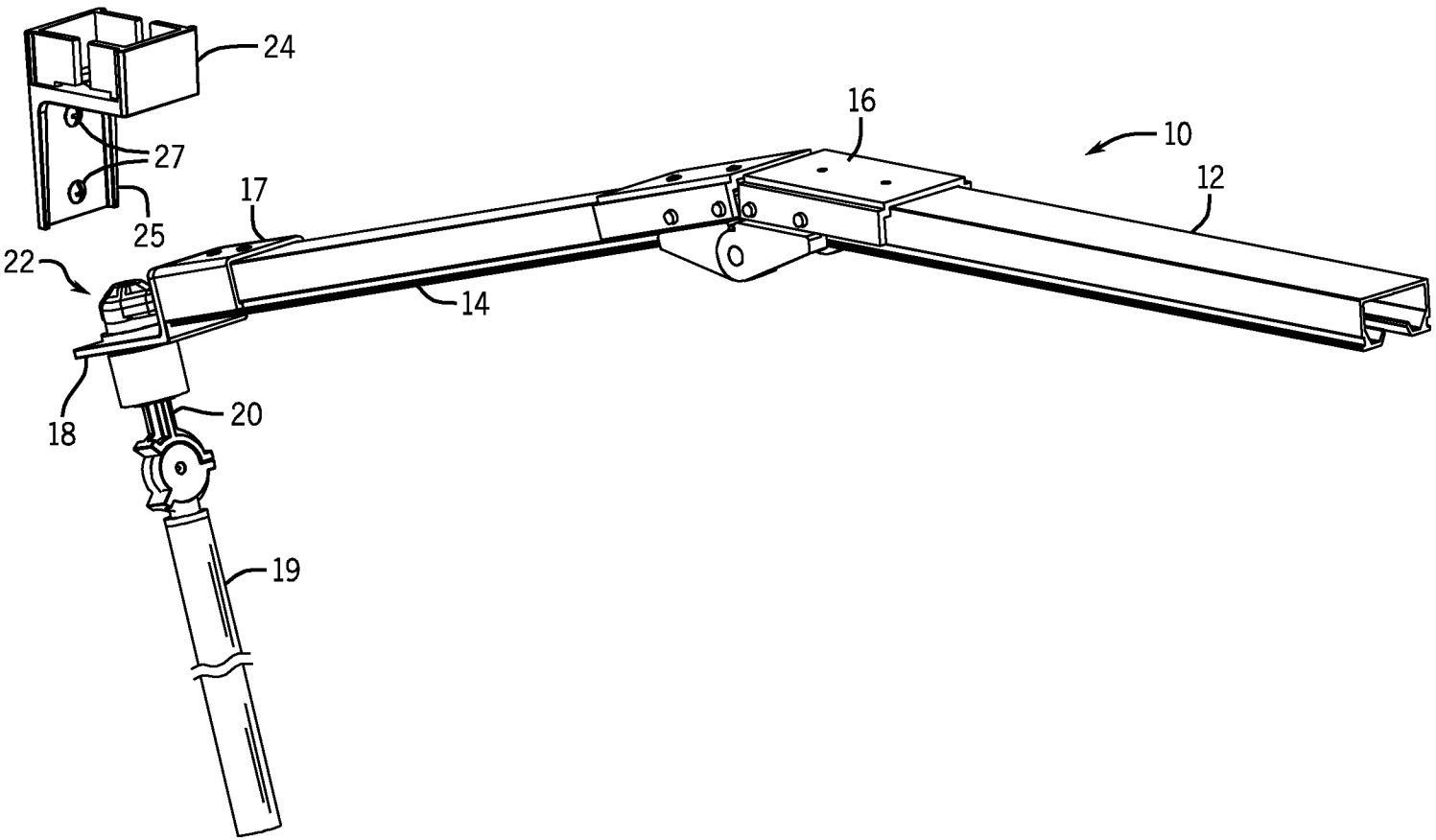
FIG. 1 is a perspective view of the hinged or lowerable and permanently affixed sections of the ceiling track joined by a hinge with the hinged section terminating in a connector to which a lock knob is affixed with the key of a control wand being inserted into the bottom of the lock knob. Also illustrated is a receiver for the lock knob which is adapted to be mounted on a wall.

FIG. 1 illustrates the latching mechanism in its operating environment. A ceiling track 10 is comprised of a section 12 which is adapted to be affixed to a ceiling, a section 14 which is adapted to be lowered to facilitate the loading and unloading of curtains onto the track and a hinge 16 which joins the two sections 12 and 14. As illustrated the operation of this latch is unrestrained and simply allows the section 14 to rotate into and out of alignment with the section 12. Section 14 has a connector 17 affixed to its end distal from the hinge 16 and this connector in turn has a flange 18 which extends beyond the end of the distal end of the section 14. A lock knob 22 is rotatably secured to this flange 18. A wand 19, useful to rotate the lock knob 18, carries a key 20 which is capable of interlocking with the lock knob 22 to transmit rotation from the wand 19 to the lock knob 22. A receiver 24 is capable of being secured to a wall via downwardly extending flange 25 which carries screw holes 27 which can be used to secure the receiver 24 at a position that when retaining the lock knob 22, it holds the section 14 in horizontal alignment with section 12.

FIGS. 2 through 4 illustrate details of the construction of the lock knob 22. It has a lower ring 26 which is spaced downwardly from its generally oval shaped main body which has two wings 28 which extend along its long axis. This ring has a top surface 29 which will interact with the bottom surface of the bottom wall of the receiver. The each of the wings 28 has a bottom surface 30 which will interact with the top surface of the bottom wall of the receiver and a tip 32 which will interact with a side wall of the receiver. The top surface 29 and the bottom surface 30 define a gap 34 which will accommodate the bottom wall of the receiver. The bottom of the lock knob 22 has a centered cylindrical recess 31 which at its upper end terminates in a rectangular recess 33. These recesses are adapted to accommodate the bottom fastener 44 for the lock knob which is illustrated in FIG. 5.

Figure 5:
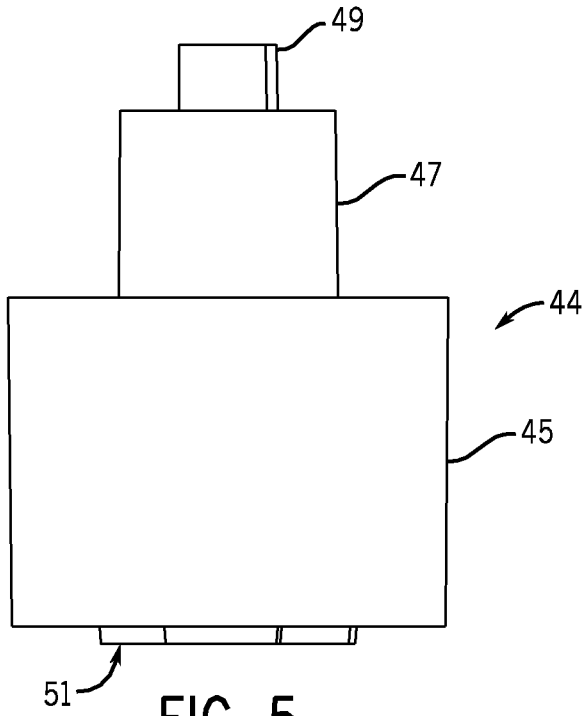
FIG. 5 is a side elevation of the bottom fastener for the lock knob.

FIG. 5 illustrates the bottom fastener 44 for the lock knob. It has a lower cylindrical body portion 45, an upper cylindrical body portion 47 with a smaller diameter than that of the lower portion 45 and it carries a rectangular body portion 49. The upper cylindrical portion 47 is adapted to closely fit within the recess 31 of lock knob 22 while the rectangular body portion 49 is adapted to closely fit within the recess 33 of the lock knob 22. The bottom of the lower portion carries a receptacle 51 which accommodates the key 20 of the wand 19 (illustrated in FIG. 1.

Figure 6:
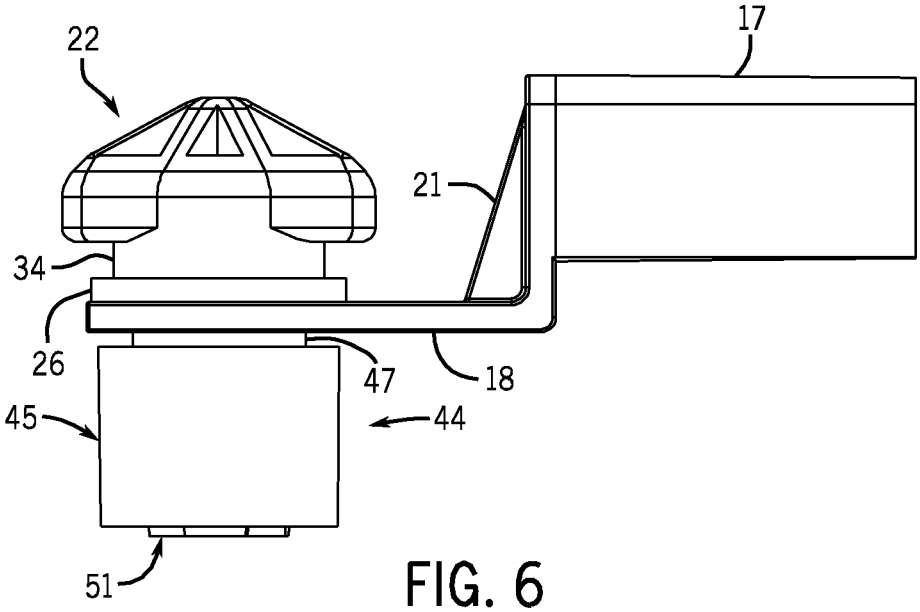
FIG. 6 is a side elevation of the lock knob affixed to the horizontal flange of the connector.

FIG. 6 illustrates the lock knob 22 rotatably secured to the flange 18 of the connector 17. The flange 18 has a circular aperture (not illustrated) through which the upper cylindrical portion 47 of the bottom fastener 44 passes. This portion 47 is mechanically secured to the lock knob 22 such that they will rotate together. The lower portion 45 of the bottom fastener 44 has a larger diameter than the aperture in the flange 18 of the connector 17. It cooperates with the bottom ring 26 of the lock knob to secure the lock knob 22 to the flange 18. The receptacle 51 which accommodates the key 20 of the wand 19 (illustrated in FIG. 1) is adapted to transmit rotation from the wand 20 to bottom securing member 44 and, in turn, the lock knob 22. The connector 17 carries ribs 21 which reinforce its connection with its flange 18.

Figure 7:
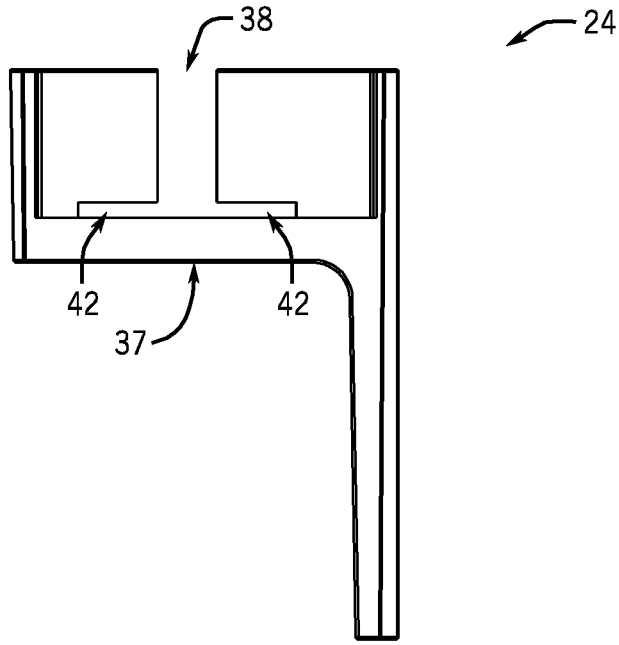
FIG. 7 is a side elevation of the lock knob receiver adapted for wall mounting.
Figure 8:
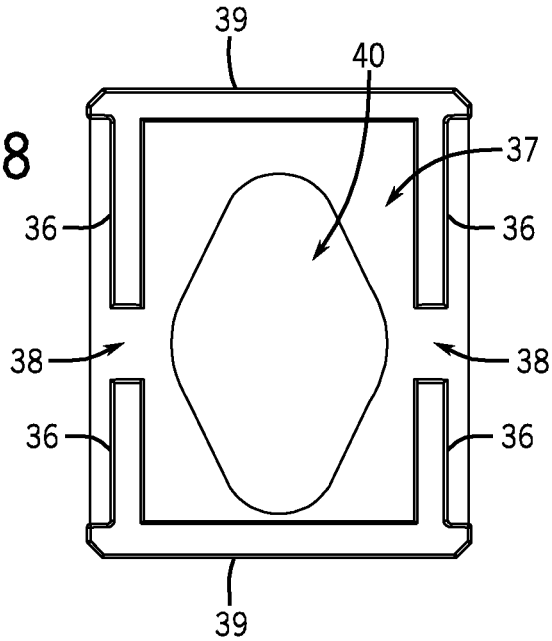
FIG. 8 is a top plan view of the lock knob receiver.

FIGS. 7 and 8 illustrate details of the construction of the receiver 24. It has two side walls 36, each of which has a gap 38. These side walls 36 are attached to a bottom wall 37 and to end walls 39. The bottom wall 37 has an aperture 40 adapted to accommodate the top generally oval shaped portion of the lock knob 22. There is a gap 42 beneath each of the side walls 36 which partially interrupts its connection with the bottom wall 37 and lessens the amount of force or torque necessary to deflect these walls outward and allow the rotation of the lock knob 22 when it is engaged with the receiver 24. As also illustrated in FIG. 1 it carries a downwardly extending flange 25 which is adapted to affix the carrier 24 to a wall adjacent to the ceiling.

Figure 9:
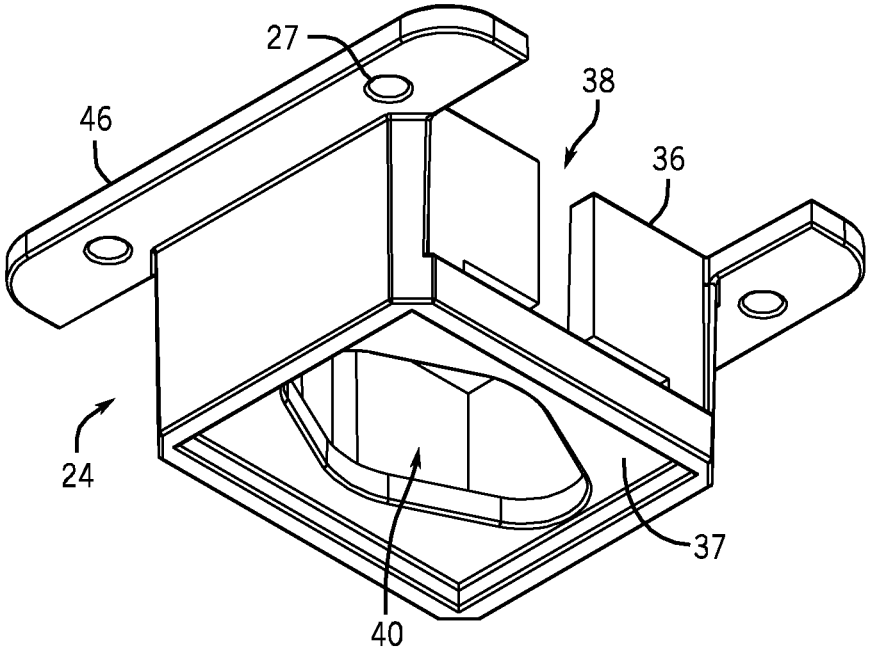
FIG. 9 is a perspective view of the lock knob receiver adapted to mount to a ceiling structure.
Figure 10:
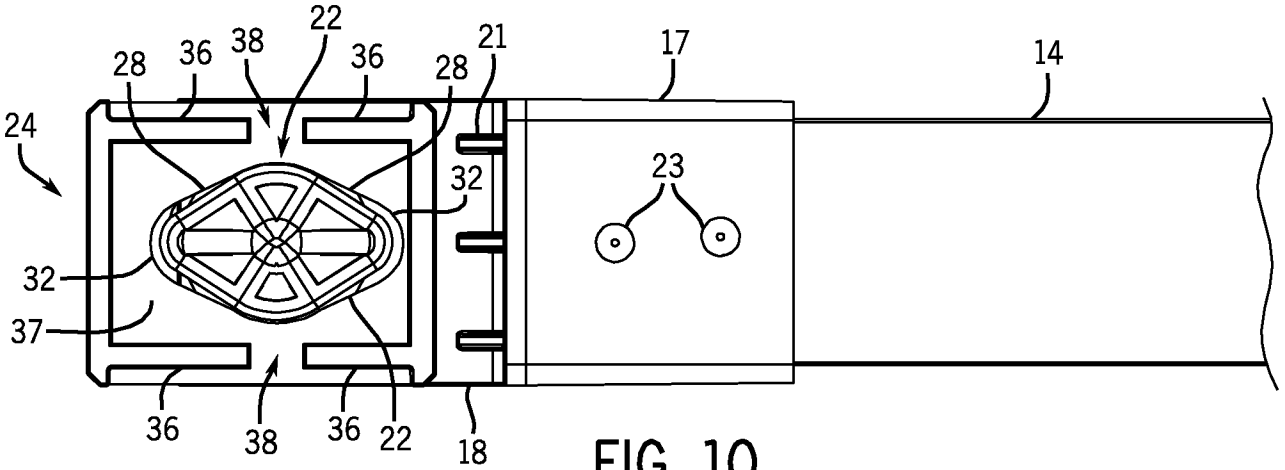
FIG. 10 is a top elevation of the lock knob inserted through the generally oval aperture of its receiver and affixed to the connector which is in turn affixed to the hinged section of the ceiling track.
Figure 11:
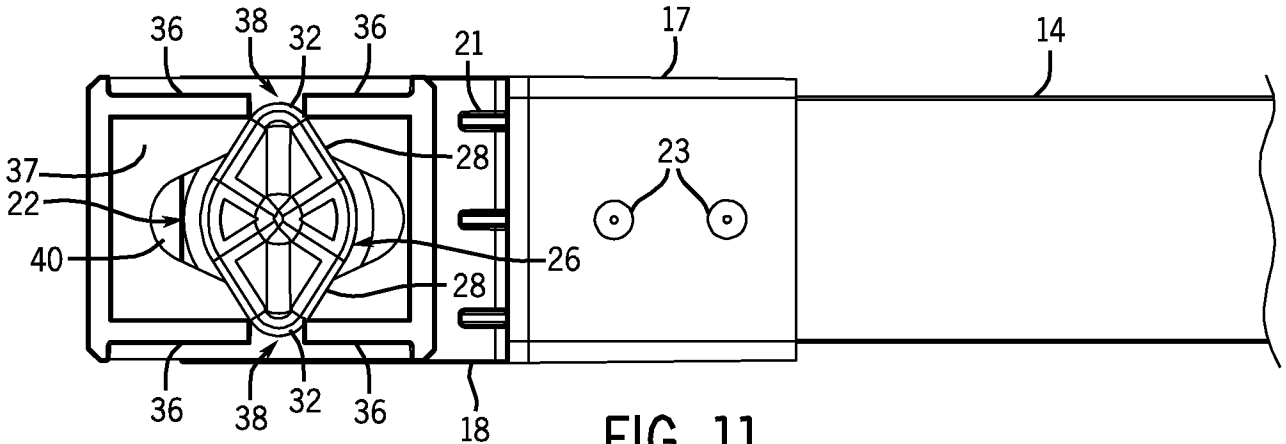
FIG. 11 is a top elevation of the lock knob inserted through the generally oval aperture of its receiver and rotated 90°. It is also affixed to the connector which is in turn affixed to the hinged section of the ceiling track.

FIG. 9 illustrates an alternative embodiment of the receiver 24 which carries flanges 46 which are adapted to secure the receiver 24 to a ceiling structure FIGS. 10 and 11 illustrate the operation of the lock knob 22 with the carrier 24. In FIG. 9 the lock knob 22 is in an unlocked position and is able to pass through the aperture 40 in the bottom wall 37 of the receiver 24. The hinged section 14 is attached to the connector 17 via rivets 23. The flange 18 of the connector 17 carries the lock knob 22 as illustrated in FIG. 5. In FIG. 10 the lock knob 22 is in a locked position and is unable to pass through the aperture 40 in the bottom wall 37 of the receiver 24. The tips 32 of the lock knob 22 protrude in the gaps 38 in the side walls 36 of the receiver 24 and restrain the lock knob 22 from rotation. The application of a sufficient amount of torque to the wand 19 (illustrated in FIG. 1) will cause the side walls 36 to deflect outward away from the axis of the lock knob 22 as they are pressed upon by the tips 32 of the lock knob 22. In the locked position shown in FIG. 10, the bottom surfaces 30 of the wings 28 of the receiver 22 (Illustrated in FIGS. 2B and 4) engages the top surface of the bottom wall 37 of the receiver 24 to support the connector 17 and the hinged section 14 of the ceiling track 12 (illustrated in FIG. 1) against downward movement. The top surface 29 (illustrated in FIGS. 2A, 3 and 4) of the bottom ring 26 (illustrated in FIGS. 2A, 2B, 4 and 5) interacts with the bottom surface of the bottom wall 37 of the receiver 24 to limit the upward travel of the lock knob 22 through the aperture 40 in the bottom wall 37 of the receiver 24 in the locked or unlocked position. The tips 32 of the lock knob 22 interact with the side walls 36 of the receiver 24 such that when these tips seat in the gaps 38 of the side walls 36 a readily audible sound is produced. This is a function of the material of which the side walls 36 are constructed and the distance that they move inward toward the axis of rotation of the lock knob 22 when the tips 32 seat in the gaps 38. The tips 32 are given a red color while the side walls 36 are white to facilitate visual detection of the tips 32 projecting into the gaps 38.

It is preferred for ease of manufacturability and minimization of cost that as many of the elements of the latching mechanism as possible be made of injection moldable polymer. It is particularly preferred that the lock knob, receiver and connector be injected molded.

It is preferred to construct both the side walls of the receiver and at least the tips of the lock knob of polymers which have a reasonably low coefficient of friction but also have a good resistance to frictional wear such that the tips slide smoothly over the inside surface of the side walls and can do so many times without any significant wear being apparent. It is also preferred to construct the side walls of the receiver of a polymer which will sustain a deflection of at least about 0.10 of an inch but still have a reasonable degree of resistance to deflection. It is particularly preferred to use a polymer with a flexural modulus of at least about 350,000 psi as determined by ASTM D790. The well known thermoplastic engineering resins are preferred. The acetal resins are particularly preferred as displaying a good balance of cost, formability and mechanical properties.

WORKING EXAMPLE

A latching mechanism was constructed in accordance with FIGS. 1-9 by injection molding CP Pryme® Acetal AC 100-9, a polyoxymethylene polymer with a flexural modulus of about 377,000 psi. The side, end and bottom walls of the receiver were 0.125 inches thick. The inside surfaces of the side walls were spaced 1.12 inches apart while the vertical gaps where 0.30 inches in width and the horizontal gaps beneath the side walls was 0.080 inches high and extended 0.40 inches from the vertical gaps towards the end walls. The distance from where the side walls joined the end wall distal from the downwardly extending flange of the receiver to the vertical gaps was 0.6 inches while the distance from the juncture with the end wall proximate to this flange was 0.788 inches. The aperture in the bottom wall of the receiver was roughly elliptical (or Oval) in shape with a long axis of 1.417 inches and a short axis of 0.90 inches with its short axis centered in the vertical gaps. The ends of the long axis had a radius of 0.248 inches and the ends of the short axis had a radius of 0.448 inches.

The lock knob had a long axis of 1.22 inches and a short axis of 0.875 inches. The radius at the ends of the long axis was 0.188 inches and the radius at the ends of the short axis was 0.875 inches. The radius of the bottom ring was 1.063 inches. The distance between the bottom of the wings of the generally oval shaped portion of the lock knob and the top of the circular ring was 0.150 inches. The ring was 0.150 inches high and the complete lock knob was 0.850 inches high. The lock knob had a centered circular recess with a diameter of 0.520 inches and a height of 0.250 inches which was surmounted by a rectangular recess 0.125 inches high, 0.471 inches long and 0.208 inches wide.

A bottom securing member with an upper cylindrical section 0.497 inches in diameter and 0.425 inches high was permanently positioned into the cylindrical recess in the bottom of the lock knob. The top of this cylindrical section carried a centered rectangular section 0.150 inches high, 0.445 inches long and 0.197 inches wide. This bottom securing member had a bottom securing member 1.0 inches in diameter and 0.750 inches high. It passed through an aperture in the flange of the connector which was 0.520 inches in diameter. This flange was 0.125 inches thick.

The lock knob was red and the side walls of the receiver were white.

The lock knob passed easily through the aperture in the bottom wall of the receiver and was repeatedly rotated until its tips seated in the vertical gaps and then rotated back so that it could pass through the aperture in the bottom wall of the receiver. The rotation in either direction was well within the digital capacity of the average person. Each time these tips seated in the vertical gaps a readily perceived click was heard and the red tips were readily visible when viewing the vertical gaps. When the tips were seated in the gaps the connector was securely held against any downward movement.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A ceiling track system for suspension of a travelling curtain comprising:

a. a fixed track section for attaching to a ceiling surface;

b. a hinged track section connected to said fixed track section by a hinge, the hinged track section adapted to be lowered from the ceiling for loading and unloading of the travelling curtain;

c. a latching mechanism for latching the hinged track section to the ceiling in continuation of the fixed track section, the latching mechanism comprising:

a receiver bracket for attaching to one of the ceiling surface and a wall surface, the receiver bracket comprising:

a bottom wall with an oval shaped aperture having a center, a long axis, and a short axis, and two vertical elastically deformable side walls, each of the two side walls being parallel to the long axis of the oval aperture and has a vertical gap, a lock knob comprising:

an oval shaped portion defining a center, a long axis, and a short axis, a pair of tips protruding from the oval shaped portion in a direction of the long axis, wherein the lock knob is adapted to rotate about the center by action of a removable mechanical actuating key;

wherein the latching mechanism comprises a locked position and an unlocked position, when said long axis of said lock knob is aligned with said long axis of said aperture, the latching mechanism is in the unlocked position, when said long axis of said lock knob is perpendicular to said long axis of said aperture, the latching mechanism is in the locked position; in the unlocked position, the lock knob passes through the aperture, the lock knob is configured to rotate about the center causing the pair of tips to force the two side walls outward during rotation and when the lock knob reaches the locked position, the tips seat in the vertical gaps formed in the two sidewalls such that when said tips seat in said gaps, an audible sound is produced.

2. The ceiling track system of claim 1 wherein said lock knob has a bottom ring spaced the oval shaped portion to define a gap accommodating the bottom wall of said receiver bracket when the long axis of said lock knob is not aligned with the long axis of said aperture.

3. The ceiling track system of claim 2 wherein said lock knob has a downwardly depending generally cylindrical shaft about which it is adapted to rotate, said shaft connecting the oval portion to the bottom ring.

4. The ceiling track system of claim 1 wherein said lock knob is rotationally secured to a flange affixed to said hinged track section.

5. The ceiling track system of claim 4 wherein a shaft which is affixed to said lock knob passes through an aperture in said flange and carries a bottom fastener which prevents said shaft from moving axially upward through said aperture to rotationally secure said lock knob to said flange.

6. The ceiling track system of claim 1 wherein said receiver bracket is constructed of an injection moldable polymer.

7. The ceiling track system of claim 1 wherein said tips of said lock knob are of a distinctive color or colors and are visible to a user when said tips are seated in said gaps of said side walls.

8. The ceiling track system of claim 1 wherein a torque required to rotate said lock knob from a position with said tips seated in said gaps to a position with its long axis aligned with the long axis of said aperture and back again is well within the manual capacity of an average person.

9. The ceiling track system of claim 8 wherein said sidewalls have gaps between their lower edges and said bottom wall of said receiver which run from said vertical gaps at least part way to where they join the side walls of said receiver which cross the long axis of said aperture in said bottom wall of said receiver.

* * * * *